US006906678B2

(12) United States Patent
Chen

(10) Patent No.: US 6,906,678 B2
(45) Date of Patent: Jun. 14, 2005

(54) MULTI-FREQUENCY PRINTED ANTENNA

(75) Inventor: Tailee Chen, Taipei (TW)

(73) Assignee: GemTek Technology Co. Ltd., Hsichu (TW)

( * ) Notice: Subject to any disclaimer, the term of this patent is extended or adjusted under 35 U.S.C. 154(b) by 19 days.

(21) Appl. No.: 10/628,256

(22) Filed: Jul. 29, 2003

(65) Prior Publication Data

US 2004/0056805 A1 Mar. 25, 2004

(30) Foreign Application Priority Data

Mar. 24, 2002 (TW) ..... 91121926 A

(51) Int. Cl.[7] ..... H01Q 9/28
(52) U.S. Cl. ..... 343/795; 343/700 MS
(58) Field of Search ..... 343/700 MS, 793, 343/795, 810

(56) References Cited

U.S. PATENT DOCUMENTS 4,800,393 A * 1/1989 Edward et al. ..... 343/821
5,598,174 A * 1/1997 Erkocevic et al. ..... 343/795
5,754,145 A * 5/1998 Evans ..... 343/795
6,337,666 B1 * 1/2002 Bishop ..... 343/795
6,339,405 B1 * 1/2002 Gleener ..... 343/795
6,650,296 B2 * 11/2003 Wong et al. ..... 343/700 MS
6,747,600 B2 * 6/2004 Wong et al. ..... 343/700 MS

* cited by examiner

*Primary Examiner*—Shih-Chao Chen
(74) *Attorney, Agent, or Firm*—Troxell Law Office, PL

(57) ABSTRACT

A multi-frequency printed antenna includes an insulating substrate, a feed strip, a ground strip, and a plurality of radiating and grounded conductive strips. The insulating substrate has a first surface and a second surface opposite to the first surface. The feed strip and the plurality of radiating conductive strips are formed on the first surface while the ground strip and the plurality of grounded conductive strips are formed on the second surface. The radiating conductive strips together with the grounded conductive strips form a multi-resonant mechanism to achieve a multi-frequency antenna radiation.

10 Claims, 5 Drawing Sheets

MULTI-FREQUENCY PRINTED ANTENNA

FIELD OF THE INVENTION

The present invention relates to a compact printed antenna structure and, more particularly, to an antenna structure capable of producing a multi-frequency resonant mechanism for the application of multi-frequency signal transmission.

BACKGROUND OF THE INVENTION

With rapid progress of wireless communication technology, mobile communication products have become the mainstream of modern science-and-technology products. These mobile communication products include a notebook computer, a cellular phone, and a personal digital assistant (PDA), etc. After coupling with the wireless communication modules, these products can link to the internet, receive and send electronic mails, and get instant information on news or stocks quotations so as to achieve functions of resource sharing and information transmitting.

A conventional "Printed Sleeve Antenna" disclosed by U.S. Pat. No. 5,598,174 relates to formation of a half wavelength resonant mechanism with extension of a ground strip to a quarter wavelength in an "L" shape and extension of a feed strip to a quarter wavelength so as to achieve effects similar to the traditional coaxial sleeve dipole. This conventional antenna design is concerned with single frequency transmission and cannot be applied in multi-frequency signal transmission. Moreover, the planar radiation field pattern is poor in omnidirectional performance due to the asymmetrical structure, and it is difficult to impedance match with a general symmetrical microstrip feeding. Furthermore, a conventional "Printed Antenna" disclosed by U.S. Pat. No. 5,754,145 relates to a printed dipole antenna with three printed strips to form a dipole mechanism so as to achieve effects similar to the traditional sleeve dipole. However, this antenna design is also concerned only with single frequency transmission.

SUMMARY OF THE INVENTION

An object of the present invention is to provide a multi-frequency printed antenna capable of producing multi-frequency resonant mechanisms for the application of multi-frequency signal transmission.

Another object of the present invention is to provide a multi-frequency printed antenna which is light and compact, and is easily linked to the feeding signals of a coaxial cable or a printed circuit, and is suitable for a hidden or built-in antenna structure.

The multi-frequency printed antenna disclosed in this invention includes an insulating substrate, a feed strip, a ground strip, and a plurality of radiating and grounded conductive strips. The feed strip is formed on the upper surface of the substrate, one end of which is connected to a signal terminal of a RF signal source, and the other end of which is in connection with the plurality of radiating conductive strips. The ground strip is formed on the lower surface of the substrate, one end of which is connected to a ground terminal of the RF signal source, and the other end of which is in connection with the plurality of grounded conductive strips. In this invention, through modification of the lengths and shapes of the radiating and grounded conductive strips, each of the radiating conductive strips together with each of the grounded conductive strips form a dipole resonant mechanism of a certain frequency so as to produce multi-frequency signal transmission.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Figure 1:
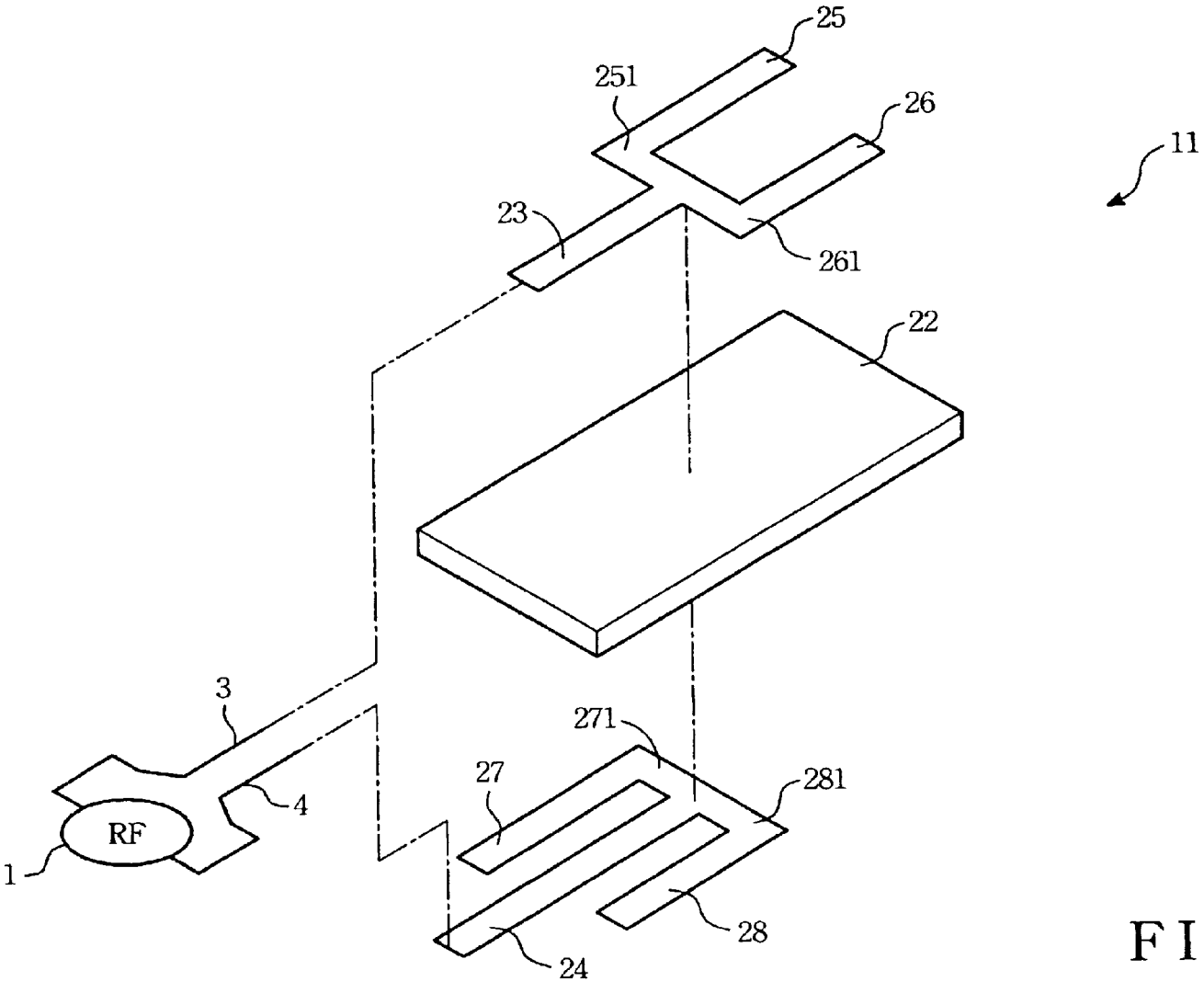
FIG. 1 is a schematic exploded diagram illustrating a first embodiment of a multi-frequency printed antenna in accordance with this invention.

Please refer to FIG. 1, which is a schematic exploded diagram illustrating a first embodiment of a multi-frequency printed antenna 11 in accordance with this invention. The antenna 11 includes a substrate 22 with an insulating plate structure, a feed strip 23, a ground strip 24, a first radiating conductive strip 25, a second radiating conductive strip 26, a first grounded conductive strip 27, and a second grounded conductive strip 28. The above-mentioned strips are all formed on two opposite surfaces of the substrate 22 in a manner of circuit printing. The substrate 22 is a circuit board made of an insulating material.

The feed strip 23 is formed on the upper surface of the substrate 22 and extends in a first direction. One end of the feed strip 23 is connected to a signal terminal 3 of a RF signal source 1. The other end of the feed strip 23 is in connection with a connecting portion 251 of the first radiating conductive strip 25 and a connecting portion 261 of the second radiating conductive strip 26. The first and second radiating conductive strip 25 and 26 are symmetrically disposed on opposite sides with respect to the feed strip 23. The feed strip 23 and the first radiating conductive strip 25 are disposed on opposite sides with respect to the connecting portion 251. The feed strip 23 and the second radiating conductive strip 26 are disposed on opposite sides with respect to the connecting portion 261. The connecting portion 251 may extend in a second direction substantially perpendicular to the first direction. Also, the connecting portion 261 may extend in the second direction. The length of the first radiating conductive strip 25 may be different from that of the second radiating conductive strip 26.

The ground strip 24 is formed on the lower surface of the substrate 22 and extends in the first direction, overlying the feed strip 23. One end of the ground strip 24 is connected to a ground terminal 4 of the RF signal source 1. The other end of the ground strip 24 is in connection with a connecting portion 271 of the first grounded conductive strip 27 and a connecting portion 281 of the second grounded conductive strip 28. The first and second grounded conductive strips 27 and 28 are mutually parallel with and properly spaced from the ground strip 24, except the connecting portions thereof to the other end of the ground strip 24. The first and second grounded conductive strips 27 and 28 are symmetrically disposed on opposite sides with respect to the ground strip 24. The ground strip 24 and the first grounded conductive strip 27 are disposed on the same side with respect to the connecting portion 271. The ground strip 24 and the second grounded conductive strip 28 are disposed on the same side with respect to the connecting portion 281. The connecting portion 271 may extend in the second direction substantially perpendicular to the first direction. Also, the connecting portion 281 may extend in the second direction. The length of the first grounded conductive strip 27 may be different from that of the second grounded conductive strip 28.

Depending on desired frequencies, the first radiating conductive strip 25 and the first grounded conductive strip 27 may be designed as a half wavelength dipole antenna of a certain desired frequency through adjustment in length or shape thereof while the second radiating conductive strip 26 and the second grounded conductive strip 28 may be independently designed as a half wavelength dipole antenna of another certain frequency. Furthermore, the first radiating conductive strip 25 and the second grounded conductive strip 28 as well as the second radiating conductive strip 26 and the first grounded conductive strip 27 may also form the other dipole resonant combinations, respectively. Thus, the antenna 11 of this invention can produce multi-frequency resonant mechanisms with dipole-like radiation patterns.

Figure 2:
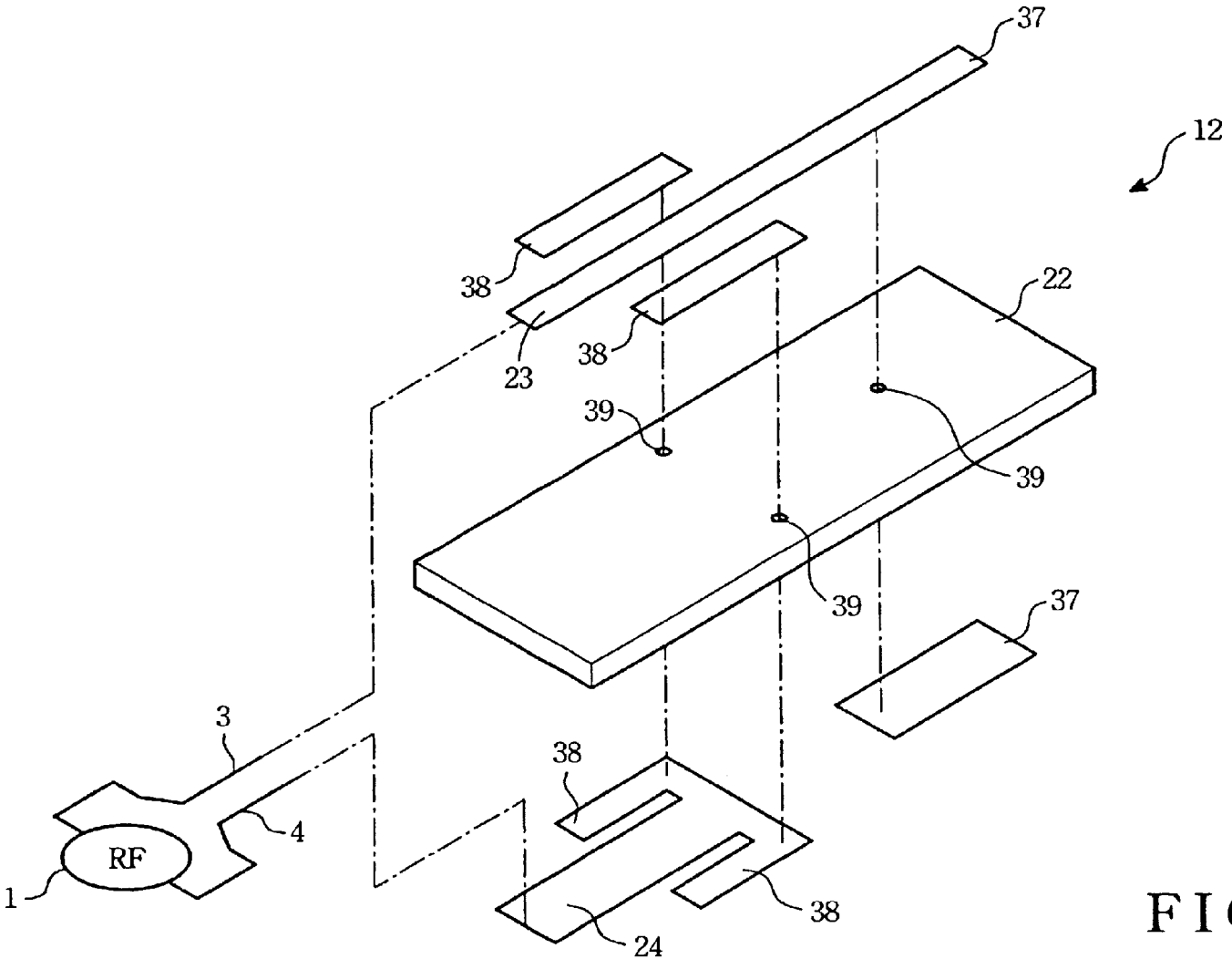
FIG. 2 is a schematic exploded diagram illustrating a second embodiment of a multi-frequency printed antenna in accordance with this invention.

Please refer to FIG. 2, which is a schematic exploded diagram illustrating a second embodiment of a multi-frequency printed antenna 12 of this invention. The antenna 12 includes a substrate 22, a feed strip 23, a ground strip 24, two radiating conductive strips 37, and four grounded conductive strips 38. Similarly to the first embodiment, the feed strip 23 has one end connected to the signal terminal 3 of the RF signal source 1. The two radiating conductive strips 37 are disposed on opposite surfaces of the substrate 22, respectively, and mutually connected through a via hole 39 opened in the substrate 22. One of the two radiating conductive strips 37 is in end-to-end connection with another end of the feed strip. Similarly, the four grounded conductive strips 38 are mutually connected in the same manner as that described in the above through other via holes 39. In this embodiment, by adjusting the lengths or shapes of the radiating conductive strips 37 and the grounded conductive strips 38, each of the radiating conductive strips 37 together with each of the grounded conductive strips 38 on the opposite surfaces of the substrate 22 may form a dipole antenna of a different frequency, respectively, so as to produce multi-frequency resonant mechanisms and to be applied in multi-frequency signal transmission.

Figure 3:
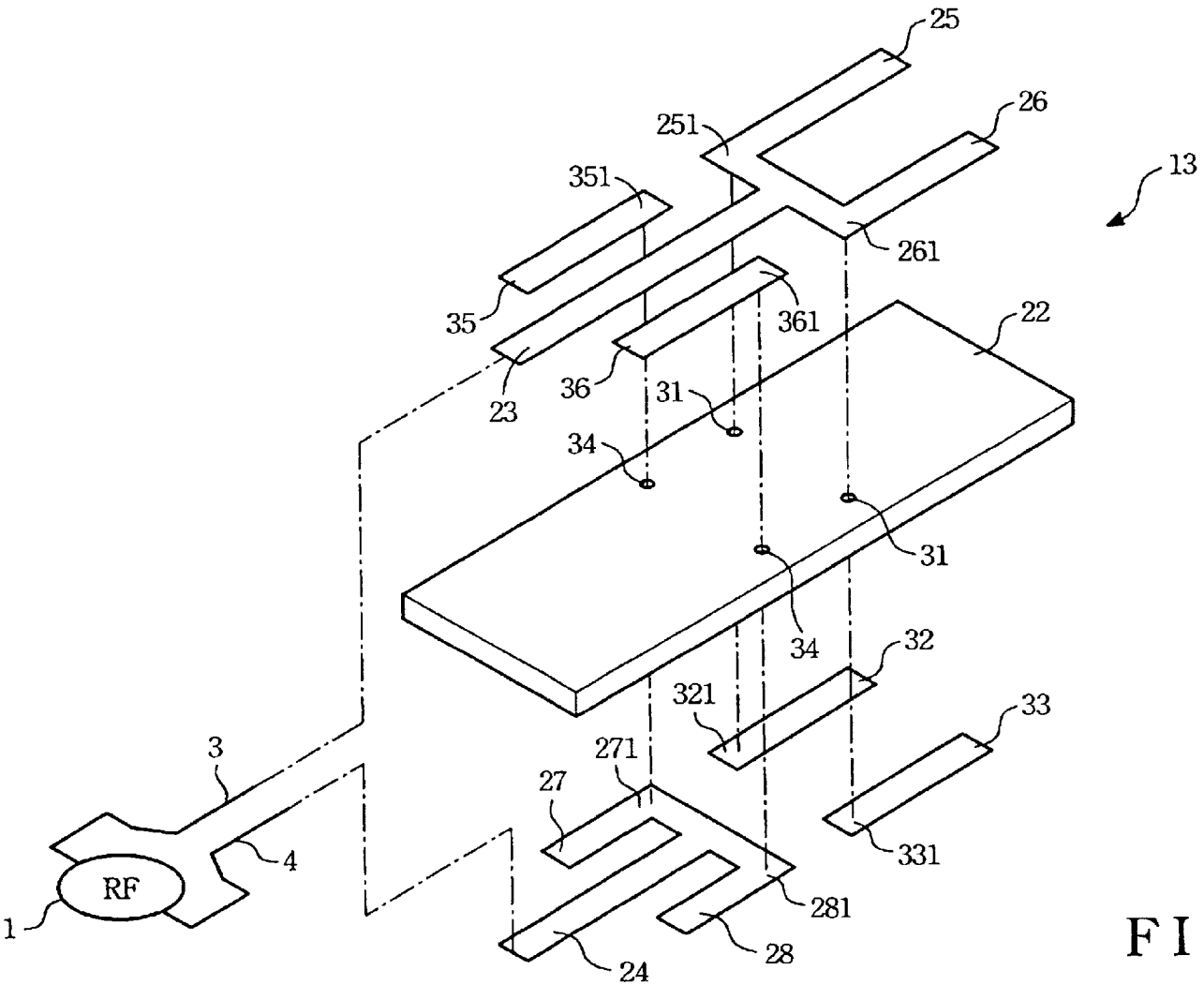
FIG. 3 is a schematic exploded diagram illustrating a third embodiment of a multi-frequency printed antenna in accordance with this invention.

Please refer to FIG. 3, which is a schematic exploded diagram illustrating a third embodiment of a multi-frequency printed antenna 13 in accordance with this invention. This embodiment is further designed on the basis of the antenna 11 of the first embodiment. More specifically, the connecting portion 251 of the first radiating conductive strip 25 is connected with one end 321 of a third radiating conductive strip 32 through a via hole 31. Also, the connecting portion 261 of the second radiating conductive strip 26 is connected with one end 331 of a fourth radiating conductive strip 33 through another via hole 31. The third and fourth radiating conductive strips 32 and 33 are formed on the lower surface of the substrate 22 in a manner of circuit printing. The third radiating conductive strip 32 extends in the first direction, overlying the first radiating conductive strip 25. Also, the fourth radiating conductive strip 33 extends in the first direction, overlying the second radiating conductive strip 26.

Furthermore, the connecting portion 271 of the first grounded conductive strip 27 is connected with one end 351 of a third grounded conductive strip 35 through a via hole 34. Also, the connecting portion 281 of the second grounded conductive strip 28 is connected with one end 361 of a fourth grounded conductive strip 36 through another via hole 34. The third and fourth grounded conductive strips 35 and 36 are formed on the upper surface of the substrate 22 in a manner of circuit printing. The third grounded conductive strip 35 extends in the first direction, overlying the first grounded conductive strip 27. Also, the fourth grounded conductive strip 36 extends in the first direction, overlying the second grounded conductive strip 28.

Figure 4:
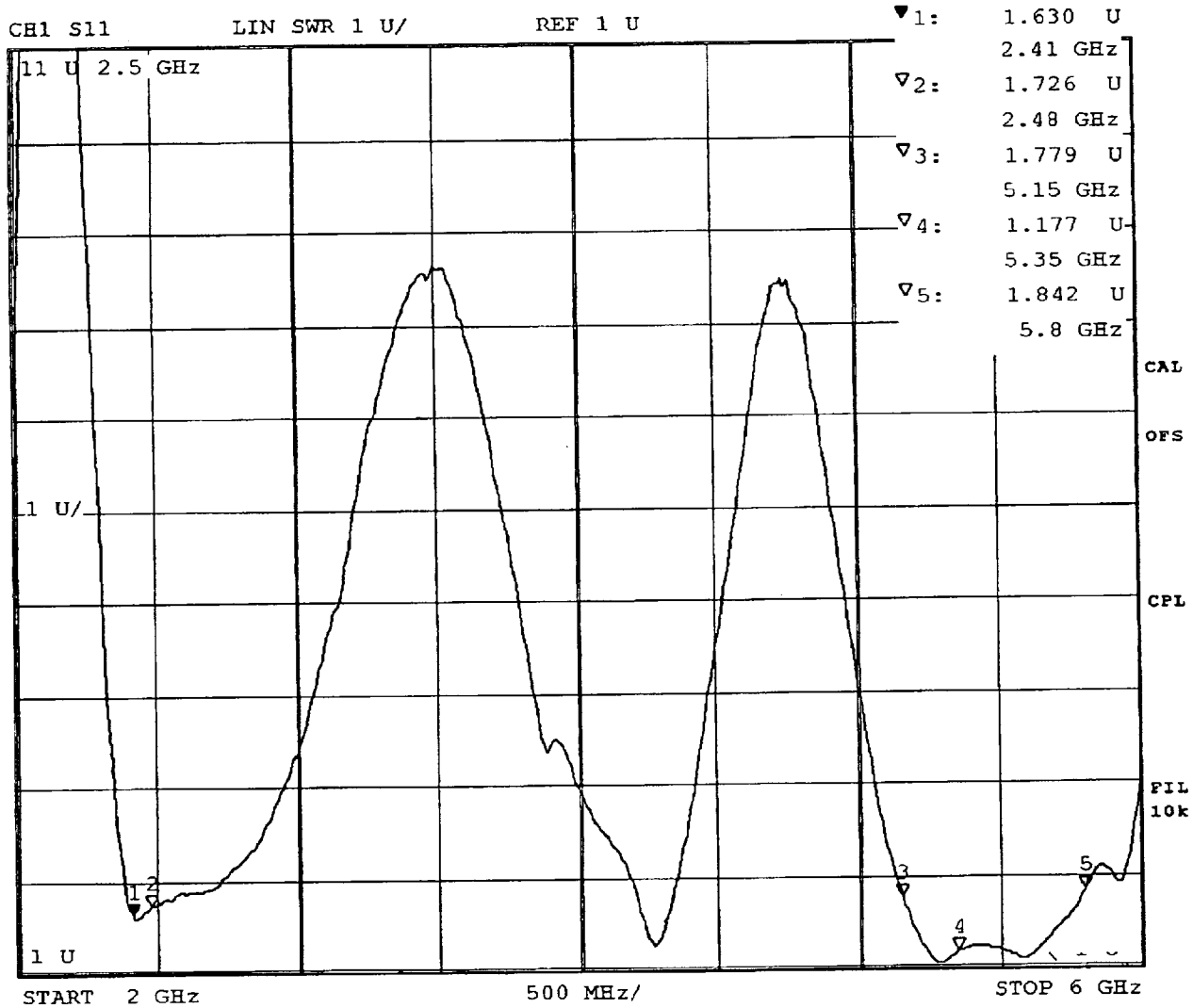
FIG. 4 is a measured drawing of the voltage standing wave ratio (VSWR) of the antenna of the third embodiment in accordance with this invention.
Figure 5:
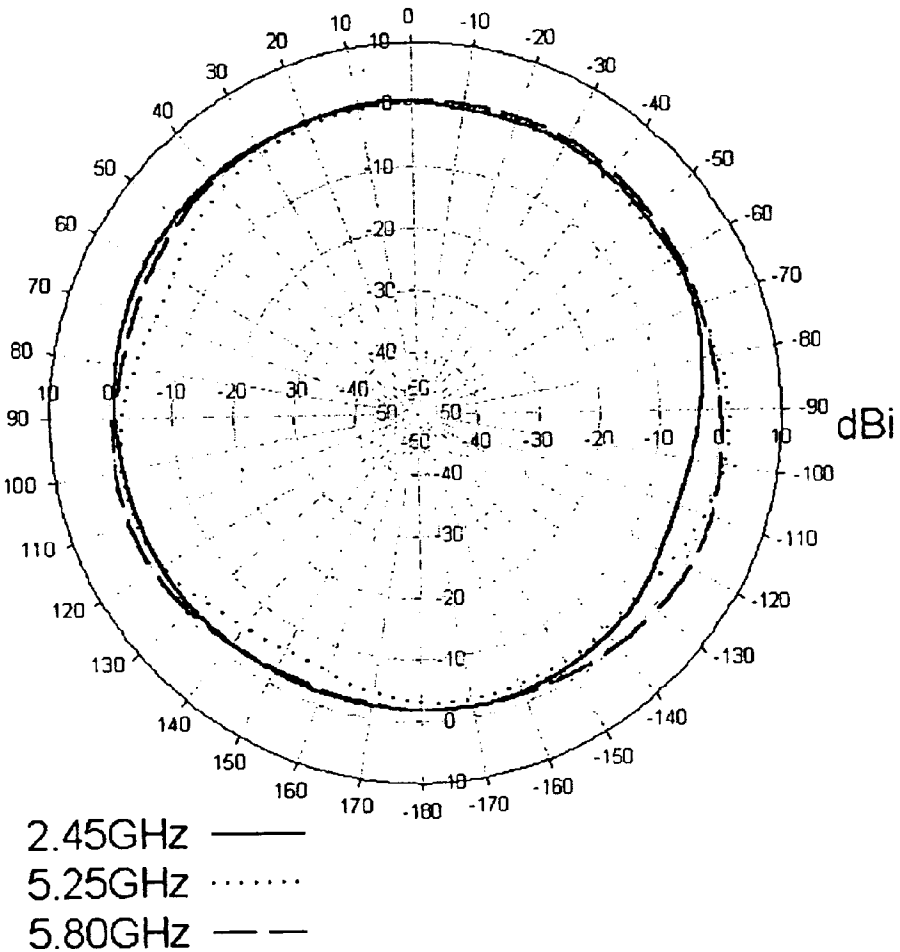
FIG. 5 is a measured drawing of the radiation field patterns on the H-plane of the third embodiment in accordance with this invention.

With such a configuration, a plurality of half wavelength dipole antenna structures, each of which is of a certain frequency, may be formed on the surfaces of the substrate 22 by adjusting the lengths and shapes of the radiating conductive strips and the grounded conductive strips such that the length of the electric current path provided by the resonant pair combined by the radiating conductive strip and the grounded conductive strip is the half of an operating wavelength or a multiple of the half operating wavelength. Comparing with the first embodiment, the third embodiment can provide more frequency selections and radiation field patterns without an additional area to the substrate. There are theoretically 16 resonant pairs (4×4) in this embodiment since each of the four radiating conductive strips 25, 26, 32, and 33 together with each of the four grounded conductive strips 27, 28, 35, and 36 form a resonant pair. FIG. 4 and FIG. 5 are the measured experimental results of the multi-frequency printed antenna 13 of this embodiment. The antenna is designed to be used in wireless LAN IEEE 802.11b at 2.4 GHz as well as IEEE 802.11a NII at 5.2 GHz and 5.8 GHz for the purpose of three-frequency application. The glass fiber plate FR4 is used as the substrate and the size thereof is 5.6 mm×50 mm×0.8 mm. FIG. 4 is the measured drawing of the voltage standing wave ratio (VSWR), showing the effects and the characteristics of the multiple frequencies thereof. FIG. 5 is the measured drawing of radiation field patterns on the H-plane at 2.45 GHz, 5.25 GHz, and 5.8 GHz. As clearly seen from FIG. 5, an omnidirectional radiation property is achieved on the horizontal plane for all desired frequency bands.

As understood by a person skilled in the art, the foregoing preferred embodiments of the present invention are only illustrated of the present invention rather than limiting of the present invention. It is intended to cover various modifications and similar arrangements included within the spirit and scope of the appended claims, the scope of which should be accorded the broadest interpretation so as to encompass all such modifications and similar structure.

What is claimed is:

1. A multi-frequency printed antenna, comprising:

a substrate with an insulating plate structure and having a first surface and a second surface opposite to the first surface;

a feed strip formed on the first surface and extending in a first direction, in which one end of the feed strip is connected to a signal terminal of a RF signal source;

a first radiating conductive strip formed on the first surface and extending in the first direction, in which the first radiating conductive strip has a first connecting portion for connecting to another end of the feed strip;

a second radiating conductive strip formed on the first surface and extending in the first direction, in which the second radiating conductive strip has a second connecting portion for connecting to the another end of the feed strip;

a ground strip formed on the second surface and extending in the first direction, in which one end of the ground strip is connected to a ground terminal of the RF signal source;

a first grounded conductive strip formed on the second surface and extending in the first direction, in which the first grounded conductive strip has a third connecting portion for connecting to another end of the ground strip; and a second grounded conductive strip formed on the second surface and extending in the first direction, in which the second grounded conductive strip has a fourth connecting portion for connecting to the another end of the ground strip, wherein the first radiating conductive strip and the first ground conductive strip form a first half wavelength dipole antenna for a first frequency transmission while the second radiating conductive strip and the second ground conductive strip form a second half wavelength dipole antenna for a second frequency transmission, wherein the first radiating conductive strip and the second ground conductive strip form a third half wavelength dipole antenna for a third frequency transmission.

2. The multi-frequency printed antenna according to claim wherein 1, the second radiating conductive strip and the first ground conductive strip form a fourth half wavelength dipole antenna for a fourth frequency transmission.

3. The multi-frequency printed antenna according to claim 1, further comprising:

a first via hole penetrating through the substrate and located at the first connecting portion;

a third radiating conductive strip formed on the second surface and extending in the first direction, overlying the first radiating conductive strip, in which the third radiating conductive strip has one end connected to the first connecting portion through the first via hole;

a second via hole penetrating through the substrate and located at the second connecting portion; and a fourth radiating conductive strip formed on the second surface and extending in the first direction, overlying the second radiating conductive strip, in which the fourth radiating conductive strip has one end connected to the second connecting portion through the second via hole.

4. The multi-frequency printed antenna according to claim 1, further comprising:

a first via hole penetrating through the substrate and located at the third connecting portion;

a third grounded conductive strip formed on the first surface and extending in the first direction, overlying the first grounded conductive strip, in which the third grounded conductive strip has one end connected to the third connecting portion through the first via hole;

a second via hole penetrating through the substrate and located at the fourth connecting portion; and a fourth grounded conductive strip formed on the first surface and extending in the first direction, overlying the second grounded conductive strip, in which the fourth grounded conductive strip has one end connected to the fourth connecting portion through the second via hole.

5. A multi-frequency printed antenna, comprising:

a substrate with an insulating plate structure and having a first surface and a second surface opposite to the first surface;

a feed strip formed on the first surface and extending in a first direction, in which one end of the feed strip is connected to a signal terminal of an a RF signal source;

a first radiating conductive strip formed on the first surface and extending in the first direction, in which the first radiating conductive strip is in end-to-end connection with another end of the feed strip;

a second radiating conductive strip formed on the second surface and extending in the first direction, overlying the first radiating conductive strip, in which the second radiating conductive strip has one end connected with the first radiating conductive strip through a first via hole opened in the substrate;

a ground strip formed on the second surface and extending in the first direction, in which one end of the ground strip is connected to a ground terminal of the RF signal source;

a first grounded conductive strip formed on the second surface and extending in the first direction, in which the first grounded conductive strip has a first connecting portion for connecting to another end of the ground strip;

a second grounded conductive strip formed on the second surface and extending in the first direction, in which the second grounded conductive strip has a second connecting portion for connecting to the another end of the ground strip;

a second via hole penetrating through the substrate and located at the first connecting portion;

a third grounded conductive strip formed on the first surface and extending in the first direction, overlying the first grounded conductive strip, in which the third grounded conductive strip has one end connected to the first connecting portion through the second via hole;

a third via hole penetrating through the substrate and located at the second connecting portion; and a fourth grounded conductive strip formed on the first surface and extending in the first direction, overlying the second grounded conductive strip, in which the fourth grounded conductive strip has one end connected to the second connecting portion through the second via hole, wherein each of the first and second radiating conductive strips together with each of the first to fourth ground conductive strips form a dipole antenna for achieving multi-frequency transmission.

6. The multi-frequency printed antenna according to claim 5, wherein the first and second grounded conductive strips are symmetrically disposed on opposite sides with respect to the ground strip.

7. The multi-frequency printed antenna according to claim 5, wherein the grounded strip and the first grounded strip are disposed on the same side with respect to the first connecting portion.

8. The multi-frequency printed antenna according to claim 7, wherein the ground strip and the second grounded conductive strip are disposed on the same side with respect to the second connecting portion.

9. The multi-frequency printed antenna according to claim 5, wherein the first connecting portion extends in a second direction substantially perpendicular to the first direction.

10. The multi-frequency printed antenna according to claim 9, wherein the second connecting portion extends in the second direction.

* * * * *